US007647670B2

(12) United States Patent
Dant et al.

(10) Patent No.: US 7,647,670 B2
(45) Date of Patent: Jan. 19, 2010

(54) VACUUM CLEANER WITH FINAL FILTRATION COMPARTMENT FOR REDUCING NOISE

(75) Inventors: Ryan T. Dant, Lexington, KY (US); Donald E. Proffitt, II, Richmond, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 877 days.

(21) Appl. No.: 11/220,944

(22) Filed: Sep. 7, 2005

(65) Prior Publication Data

US 2007/0050939 A1 Mar. 8, 2007

(51) Int. Cl.
*A47L 9/00* (2006.01)

(52) U.S. Cl. ..... 15/326; 15/347

(58) Field of Classification Search ..... 15/326, 15/347; *A47L 9/00*

See application file for complete search history.

(56) References Cited

U.S. PATENT DOCUMENTS 6,085,382 A * 7/2000 Bobrosky et al. ..... 15/350
6,213,251 B1 * 4/2001 Kesselring ..... 181/249

* cited by examiner

*Primary Examiner*—David A Redding
(74) *Attorney, Agent, or Firm*—King & Schickli, PLLC

(57) ABSTRACT

A vacuum cleaner is provided including a housing having a nozzle assembly with a suction inlet and a canister assembly with a dirt collection vessel receiver. A suction generator is carried on the housing. A dirt collection vessel is received in the receiver. A final filtration compartment is provided on the housing. The final filtration compartment includes an air inlet having a cross sectional surface area A and an air outlet having a cross sectional surface area B where the ratio of B to A is at least 0.8 to 1. The vacuum cleaner also includes a final filter received in the final filtration compartment.

11 Claims, 6 Drawing Sheets

VACUUM CLEANER WITH FINAL FILTRATION COMPARTMENT FOR REDUCING NOISE

TECHNICAL FIELD

The present invention relates generally to the floor care equipment field and, more particularly, to a vacuum cleaner incorporating a novel final filtration compartment for reducing the operating noise of the vacuum cleaner.

BACKGROUND OF THE INVENTION

A vacuum cleaner is an electromechanical appliance utilized to effect the dry removal of dust, dirt and other small debris from carpets, rugs, fabrics or other surfaces in domestic, commercial and industrial environments. In order to achieve the desired dirt and dust removal, most vacuum cleaners incorporate a rotary agitator. The rotary agitator is provided to beat dirt and debris from the nap of the carpet or rug while a pressure drop or vacuum is used to force air entrained with this dirt and debris into the nozzle of the vacuum cleaner. The particulate laden air is then drawn through a dirt collection vessel such as a bag-like filter, a removable dirt cup or a cyclonic separation chamber and filter combination which traps the dirt and debris while the substantially clean air is exhausted by an electrically operated fan that is driven by an onboard motor. It is this fan and motor arrangement that generates the drop in air pressure necessary to provide the desired cleaning action. Thus, the fan and motor arrangement is commonly known as the vacuum or suction generator.

The present invention relates to a vacuum cleaner equipped with a novel final filtration compartment that effectively reduces the operating noise of the vacuum cleaner by reducing the velocity of the airflow being exhausted or returned to the environment.

SUMMARY OF THE INVENTION

In accordance with the purposes of the present invention as described herein, an improved vacuum cleaner is provided. The vacuum cleaner comprises a housing including a nozzle assembly having a suction inlet and a canister assembly having a dirt collection vessel receiver. A suction generator is carried on the housing. A dirt collection vessel is received in the dirt collection vessel receiver. A final filtration compartment is also provided on the housing. The final filtration compartment includes an air inlet having a cross sectional surface area A and an outlet having a cross sectional surface area B where the ratio of B to A is at least 0.8 to 1, typically 0.8 to 1 to about 1.2 to 1, more typically 0.9 to 1 to about 1.1 to 1 and most typically about 0.95 to 1. In addition, a final filter is received in the final filtration compartment.

More specifically describing the invention, the inlet of the final filtration compartment has a cross sectional surface area of between about 1950 to about 2150 $mm^2$ and the outlet has a cross sectional area of between about 1850 to about 2050 $mm^2$.

In accordance with the present invention the outlet directs airflow in a first direction and a second direction. The first direction is substantially perpendicular to the second direction. In addition the air flows through the final filter in a third direction. The third direction is substantially opposite the first direction.

The final filtration compartment comprises an assembly including a main body and a removable access door. Fasteners connect the main body and the access door. In addition the final filter, received in the final filtration compartment, has a cross sectional surface area of between about 12,300 to about 12,500 $mm^2$.

The dirt collection vessel may comprise any number of structures including, for example, a filter bag and a dirt cup. The dirt cup may include a cylindrically shaped dirt collection chamber. Such a chamber allows for cyclonic airflow and the beneficial cleaning action produced by such airflow. Further the vacuum cleaner may include a rotary agitator carried by the nozzle assembly.

In the following description there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
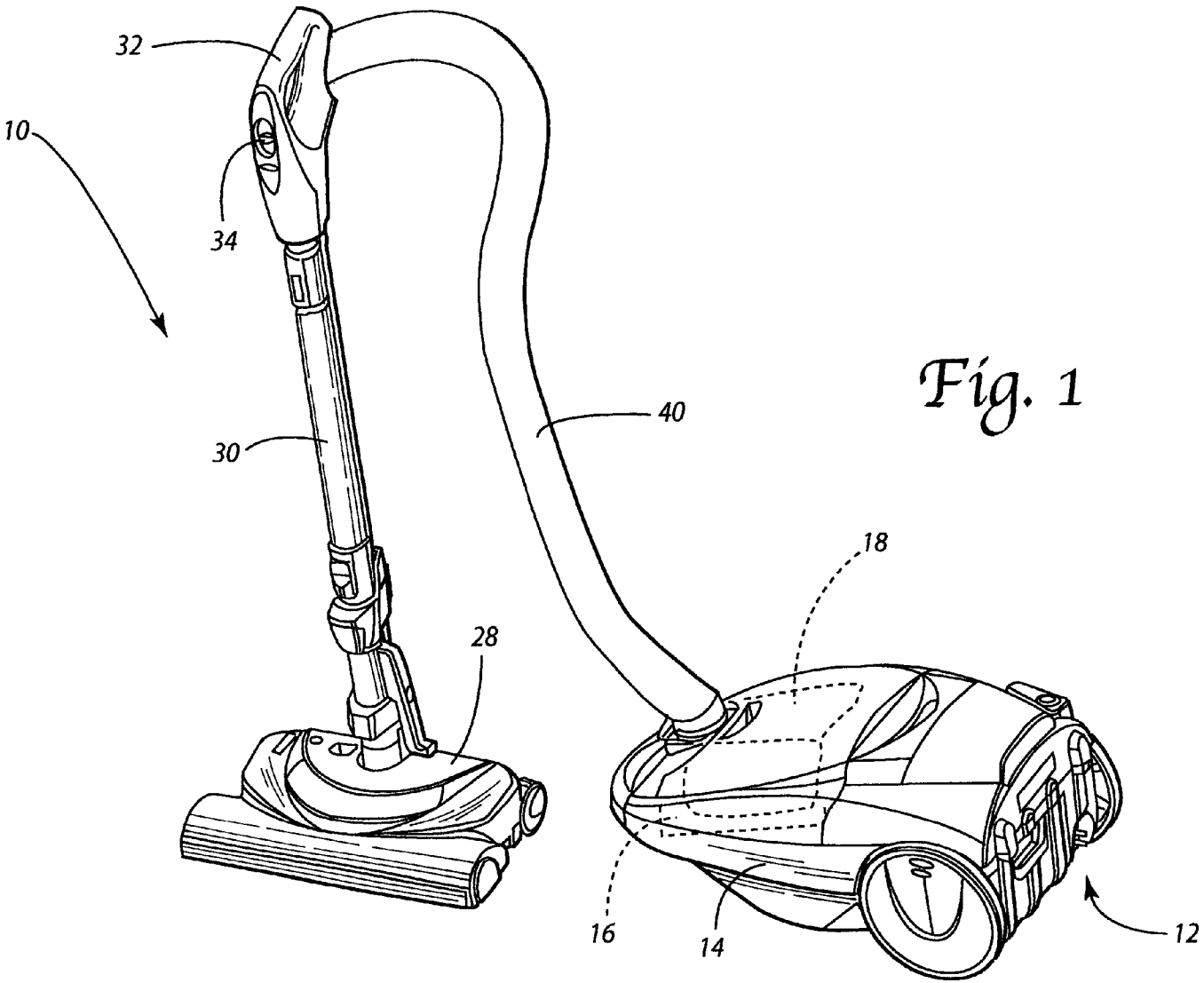
FIG. 1 is a perspective view of the canister vacuum cleaner of the present invention incorporating a unique final filtration compartment that provides more quiet operation.
Figure 2:
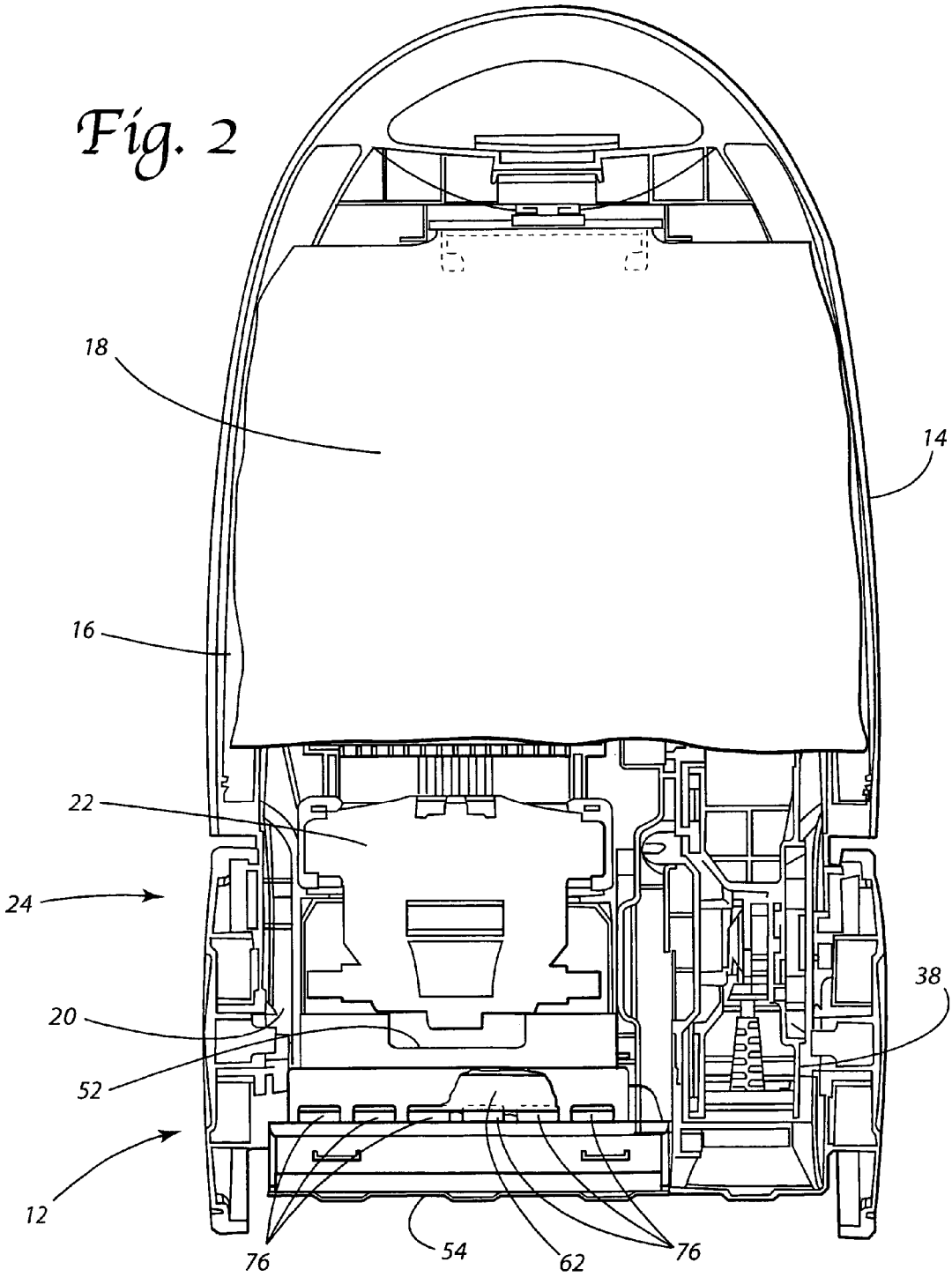
FIG. 2 is a top plan view illustrating the internal structure of the canister vacuum cleaner shown in FIG. 1.

Reference is now made to FIGS. 1 and 2 illustrating a vacuum cleaner 10 of the present invention incorporating a novel final filtration compartment 12. As illustrated, the vacuum cleaner 10 is a canister vacuum cleaner. It should be appreciated, however, that the present invention also relates to and includes upright vacuum cleaners equipped with a final filtration compartment 12 of the type described.

In the illustrated embodiment, the canister vacuum cleaner 10 includes a canister housing 14 that includes a receiver 16 for receiving a dirt collection vessel 18 used to collect dirt and debris in a manner known in the art. More specifically, the dirt collection vessel 18 may comprise, for example, a filter bag as illustrated or a dirt cup. In one possible embodiment, the dirt cup may include a cylindrically shaped dirt collection chamber in order to allow for cyclonic airflow and the cleaning action associated with such airflow. If desired, a primary filter (not shown) may be provided in the dirt cup or downstream from the dirt cup. The canister housing also includes a compartment 20 that receives a suction generator 22 that is held in a suction generator enclosure 24 in a manner described in greater detail below.

The canister vacuum cleaner 10 also includes a powerhead or nozzle assembly 28 equipped with a rotary agitator (not shown). The nozzle assembly 28 is connected to a wand 30 including a control handle 32 incorporating an actuator 34 for turning the vacuum cleaner on and off. A cord reel 38 takes up and pays out an electrical cord (not shown) which is connected to an electrical wall outlet to provide power to the vacuum cleaner 10. A flexible hose 40 includes a cuff 27 at the proximal end thereof that connects the wand 30 to the dirt collection vessel 18 in the canister housing 14 through the port 29.

Figure 3:
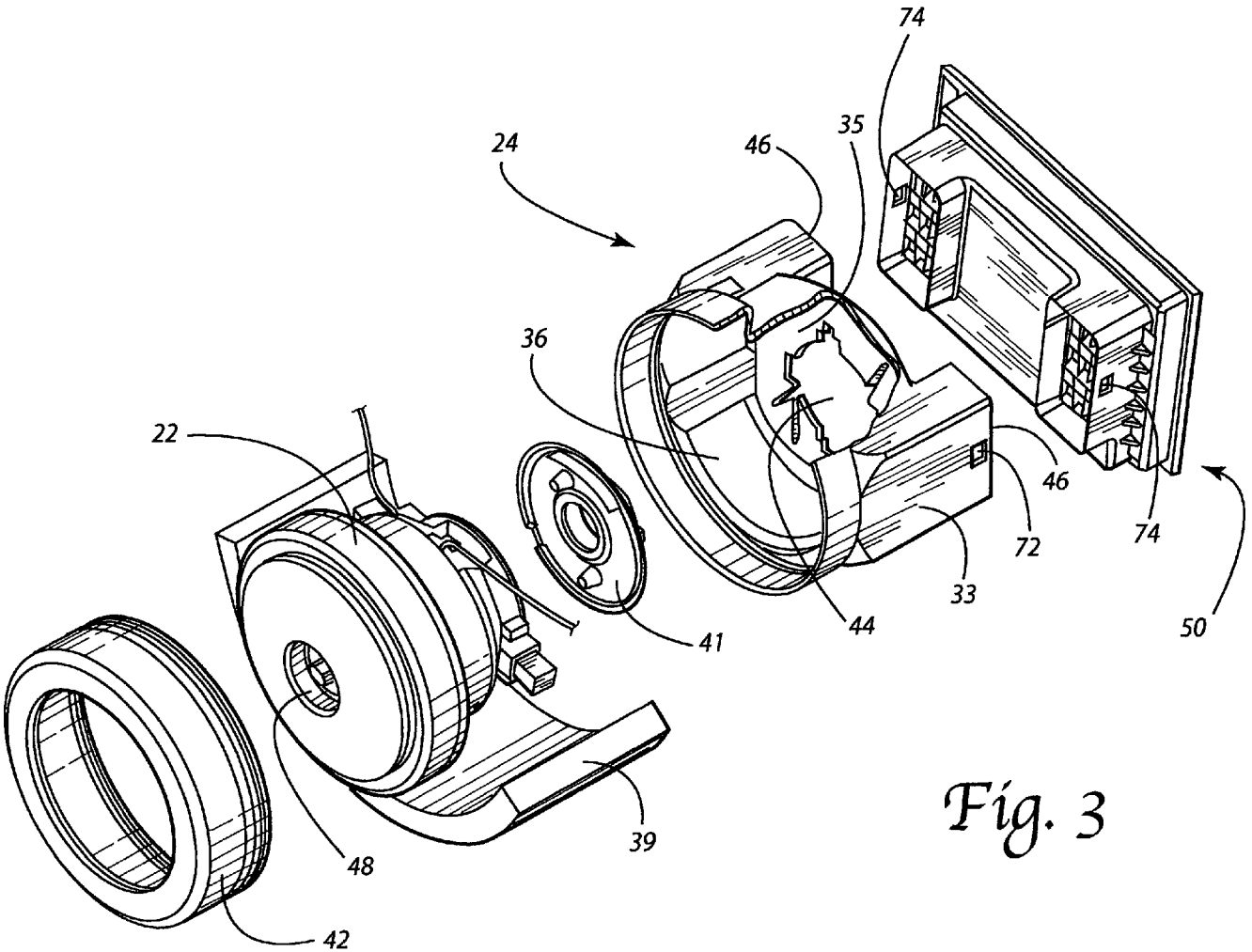
FIG. 3 is an exploded perspective view showing the suction generator, suction generator enclosure and a portion of the final filtration compartment of the canister vacuum cleaner of the present invention.
Figure 4:
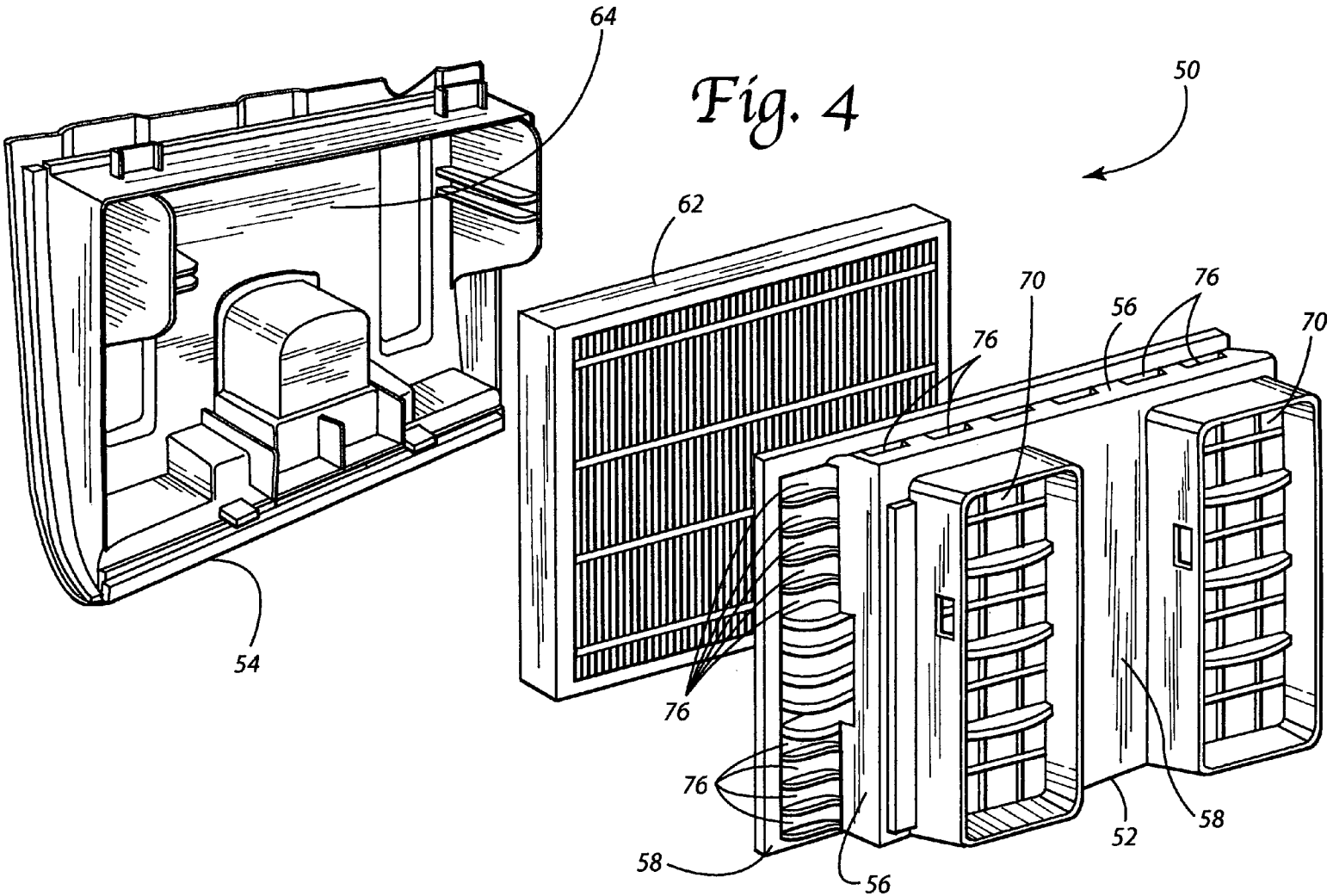
FIG. 4 is a detailed, exploded front perspective view of the final filtration compartment including the main body, the final filter and the access door thereof.
Figure 5:
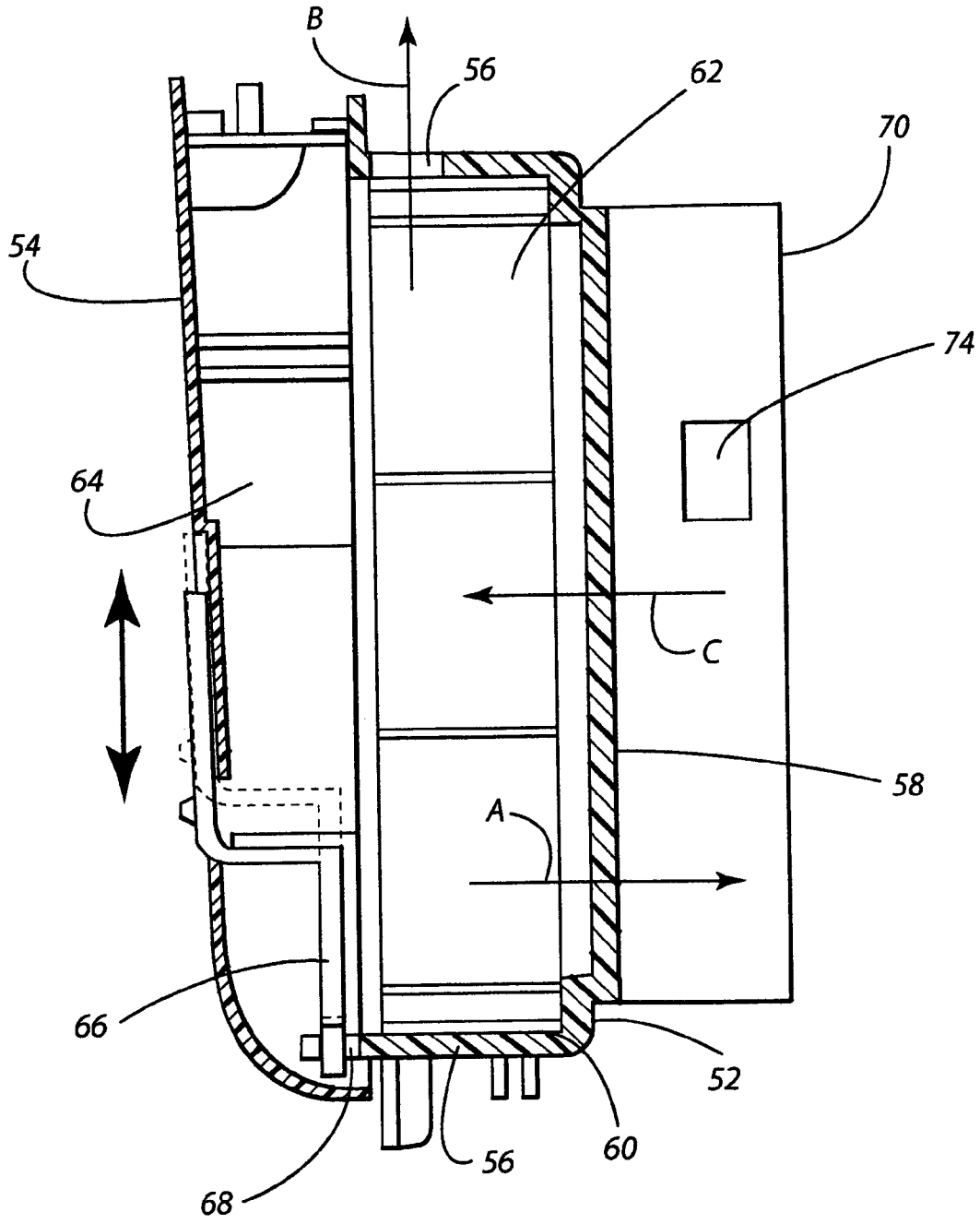
FIG. 5 is a vertical cross sectional view taken through the final filtration compartment of FIG. 4.
Figure 6:
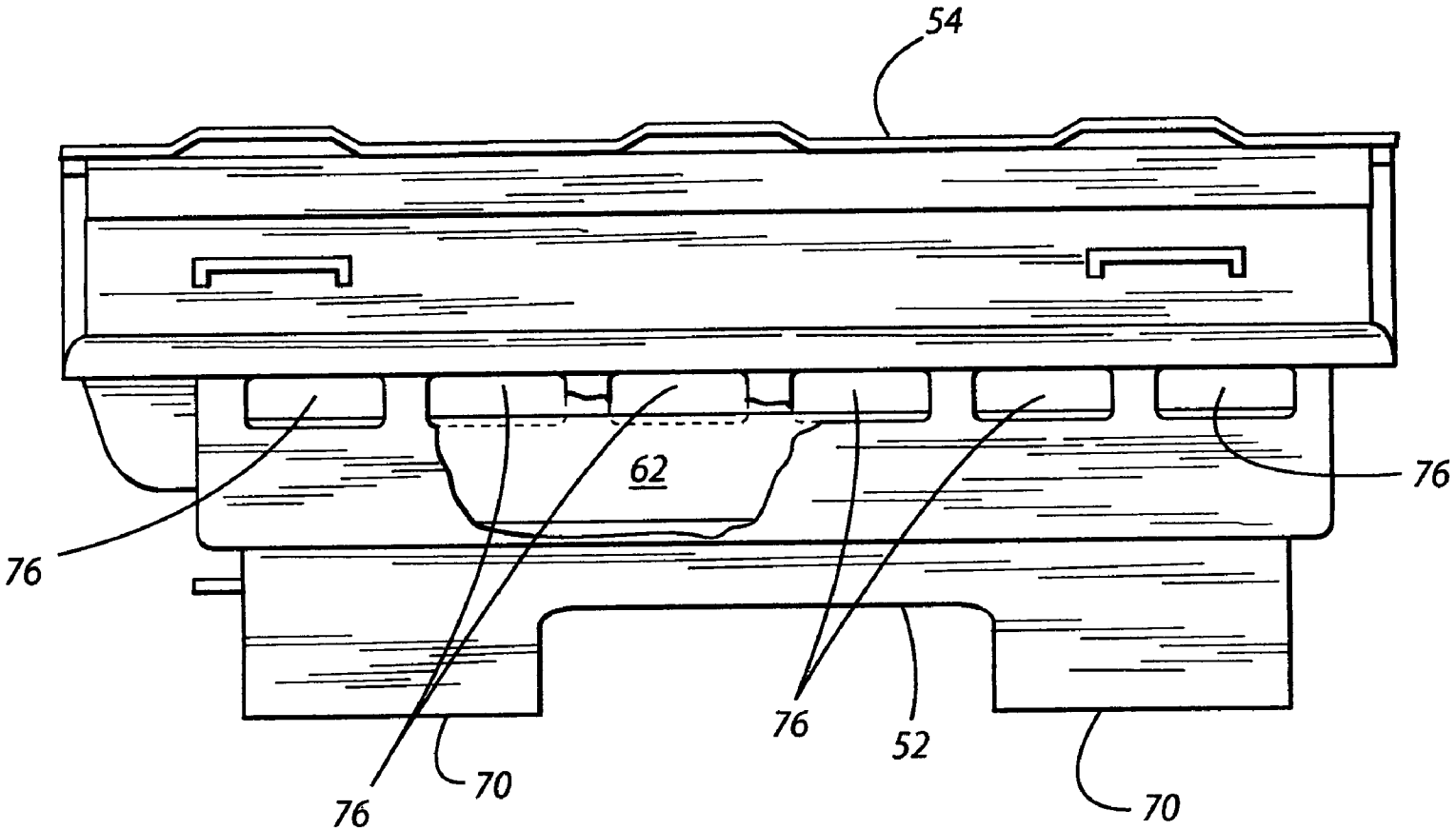
FIG. 6 is a horizontal cross sectional view taken through the final filtration compartment of FIG. 4.

Reference is now made to FIG. 3 which illustrates how the suction generator 22 is mounted and held in the suction generator enclosure 24. The enclosure 24 comprises a housing including a sidewall 33 and a rear wall 35 defining a cavity 36 for receiving the suction generator 22. The cavity 36 includes sufficient clearance to allow the suction generator 22 to be wrapped in a sheet of sound insulating material 39. A pair of motor supports 41, 42 constructed from vibration damping material such as low durometer rubber are received on the outer housing of the suction generator 22. As illustrated, the small motor support 41 engages the rear of the housing of the suction generator 22 and is received in a cutout opening 44 in the rear wall 35 of the enclosure 24. The other motor support 42 is an annular ring received over the front of the housing of the suction generator 22. This ring 43 engages the margin of the sidewall 33 defining the enclosure 24. Together, the motor supports 41, 42 seal the suction generator 22 in the enclosure 24.

As should be further appreciated from viewing FIG. 2, the rear wall 35 of the enclosure 24 also includes a pair of exhaust ducts 46. Thus, air drawn into the suction generator 22 through the inlet opening 48 passes over the motor of the suction generator to provide cooling before being exhausted from the enclosure 24 through the exhaust ducts 46. That air is delivered to the final filtration compartment 50. As illustrated in FIGS. 3-6, the final filtration compartment 50 comprises an assembly including a main body 52 and a removable access door 54. More specifically, the main body 52 includes four sidewalls 56 and an end wall 58 that define a cavity 60 for receiving a final filter 62 such as a filter media cartridge of a type known in the art (i.e. a HEPA filter).

The access door 54 includes a concavity 64 that defines an exhaust manifold. A fastener such as a sliding latch 66 on the access door 54 and a latch receiving slot 68 on the main body 52 allow the access door 54 to be releasably secured to the main body 52. As should be appreciated, the filter 62 may be accessed and changed by releasing the latch 66 from the latch receiving slot 68 and removing the access door 54.

A pair of air inlets 70 are provided in the end wall 58 of the main body 52. The air inlets 70 correspond in size, spacing and shape to the exhaust ducts 46 on the suction generator enclosure 24. In fact, the final filtration compartment 50 is secured to the suction generator enclosure 24 with the air inlets 70 in sealed communication with the exhaust ducts 46 by means of resilient fasteners 72 provided on the enclosure 24 that are received in cooperating apertures 74 in the wall of the main body 52 defining the inlets 70.

Exhaust outlets 76 are also provided in the final filtration compartment 50. More specifically, a first series of exhaust outlets 76 are provided in the top sidewall 56 while a second series of outlets 76 are provided in the stepped portion of the end wall 58. Air passing through the outlets 76 in the stepped end wall 58 travels in a first direction (see action arrow A in FIG. 5) while air being exhausted through the outlets 76 in the top sidewall 56 travels in a second direction (note action arrow B in FIG. 5). The first and second directions are substantially perpendicular to one another. Further, it should be appreciated that air passing into the final filtration compartment 50 through the air inlets 70 passes in a third direction (see action arrow C in FIG. 5) through the filter 62 and then into the concavity 64 forming the exhaust manifold before turning 90 degrees and being exhausted through the outlets 76 in the top sidewall 56 or turning 180 degrees and moving in the opposite direction before being exhausted through the outlets 76 in the end wall 58. Advantageously, this turning of the air and the directing of exhaust airstreams into two substantially perpendicular directions serves to significantly muffle the noise coming from the suction generator 22 of the vacuum cleaner 10.

In addition, it should be appreciated that the air inlets 70 and air outlets 76 of the final filtration compartment 50 are provided with relative cross sectional areas so as to decrease air velocity and thereby further reduce operating noise. More specifically, the air inlets 70 have a combined cross-sectional surface area A and the air outlets 76 have a combined cross-sectional surface area B where the ratio of B to A is at least 0.8 to 1 and is typically 0.8 to 1 to about 1.2 to 1, more typically 0.9 to 1 to about 1.1 to 1 and most commonly about 0.95 to 1. Specifically, the air inlets 70 have a cross-sectional area of between about 1950 to about 2150 $mm^2$ while the outlets 76 have a cross-sectional area of between about 1850 to about 2050 $mm^2$. The final filter 62 has a cross sectional surface area of between about 12,300 to about 12,500 $mm^2$.

By increasing the cross sectional area of the inlet 70 over that found in prior art designs and maintaining the indicated ratio between the cross sectional area of the inlets 70 and the outlets 76, airflow velocity is reduced and the operating noise of the vacuum cleaner 10 is attenuated. Further, noise attenuation is provided by both splitting and redirecting the exhaust airstream through the outlets 76 at the top and rear of the enclosure 24.

The foregoing description of a preferred embodiment of the present invention has been presented for purposes of illustration and description. It is not intended to be exhaustive or to limit the invention to the precise form disclosed. Obvious modifications or variations are possible in light of the above teachings.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A vacuum cleaner, comprising:

a housing including a nozzle assembly having a suction inlet and a canister assembly having a dirt collection vessel receiver;

a suction generator carried on said housing;

a dirt collection vessel received in said receiver;

a final filtration compartment on said housing, said final filtration compartment including (a) an air inlet having a cross sectional surface area of between about 1950 to about 2150 $mm^2$ and (b) and air outlet having a cross sectional surface area of between about 1850 to about 2050 $mm^2$ and, wherein said outlet directs airflow in a first direction and a second direction; and a final filter received in said final filtration compartment, said final filter having a cross sectional surface area of between about 12,300 to about 12,500 $mm^2$.

2. The vacuum cleaner of claim 1, wherein said first direction is substantially perpendicular to said second direction.

3. The vacuum cleaner of claim 2, wherein air flows through said final filter in a third direction, said third direction being substantially opposite said first direction.

4. The vacuum cleaner of claim 3, wherein said final filtration compartment comprises an assembly including a main body and a removable access door.

5. The vacuum cleaner of claim 4, wherein fasteners connect said main body and said access door.

6. A vacuum cleaner, comprising:

a housing including a nozzle assembly having a suction inlet and a canister assembly having a dirt collection vessel receiver;

a suction generator carried on said housing;

a dirt collection vessel received in said receiver;

a final filtration compartment on said housing, said final filtration compartment including (a) an air inlet having a cross sectional surface area A and (b) an air outlet having a cross sectional surface area B where the ratio of B to A is at least 0.8 to 1; and, wherein said outlet directs airflow in a first direction and a second direction and a final filter received in said final filtration compartment.

7. The vacuum cleaner of claim 6, wherein said first direction is substantially perpendicular to said second direction.

8. The vacuum cleaner of claim 7, wherein air flows through said final filter in a third direction, said third direction being substantially opposite said first direction.

9. A vacuum cleaner, comprising:

a housing including a nozzle assembly having a suction inlet and a canister assembly having a dirt collection vessel receiver;

a suction generator carried on said housing;

a dirt collection vessel received in said receiver;

a final filtration compartment on said housing, said final filtration compartment including an air inlet;

and an air outlet directing airflow in a first direction and a second direction wherein said first and second directions are substantially perpendicular to one another; and a final filter received in said final filtration compartment wherein airflow through said final filter is in a third direction and said third direction is substantially opposite said first direction.

10. A vacuum cleaner, comprising:

a housing including a nozzle assembly having a suction inlet and a canister assembly having a dirt collection vessel receiver;

a suction generator carried on said housing;

a dirt collection vessel received in said receiver;

a final filtration compartment on said housing, said final filtration compartment including an air inlet;

and an air outlet directing airflow in a first direction and a second direction wherein said first and second directions are substantially perpendicular to one another; and a final filter received in said final filtration compartment.

11. The vacuum cleaner of claim 9, wherein said air inlet has a cross sectional surface area A and said air outlet has a cross sectional surface area B where the ratio of B to A is between about 0.8 to about 1.2 to 1.

* * * * *